US005746228A

United States Patent [19]

Parker

[11] Patent Number: 5,746,228

[45] Date of Patent: May 5, 1998

[54] TRAVELLING HAIR DRYING CURLING AND STYLING APPARATUS

[76] Inventor: Mary C. Parker, 213 Bradish, Lajunta, Colo. 80150

[21] Appl. No.: 645,297

[22] Filed: May 13, 1996

[51] Int. Cl.[6] ..... A45D 1/04

[52] U.S. Cl. ..... 132/232; 132/269; 132/271; 132/313

[58] Field of Search ..... 132/223, 226, 132/227, 229, 232, 269, 271, 313; 219/222, 536; 338/221

[56] References Cited

U.S. PATENT DOCUMENTS

| | | | |
|---|---|---|---|
| 3,157,184 | 11/1964 | Lee et al. | 132/232 |
| 3,581,055 | 5/1971 | Makino | 132/229 |
| 4,032,747 | 6/1977 | Kunz | 219/222 |
| 4,192,325 | 3/1980 | Liedtke | 132/271 |
| 4,354,092 | 10/1982 | Manabe et al. | 132/232 |
| 4,641,010 | 2/1987 | Abura et al. | 219/222 |
| 5,435,327 | 7/1995 | Ho | 132/271 |

FOREIGN PATENT DOCUMENTS

| | | | |
|---|---|---|---|
| 2255906 | 11/1992 | United Kingdom | 219/222 |

*Primary Examiner*—Todd E. Manahan
*Assistant Examiner*—E. Robert

[57] ABSTRACT

A travelling hair drying, curling, and styling apparatus comprised of a battery powered hollow cylindrical housing having an indented upper end. The indented upper end has a pair of electric prongs extending upwardly therethrough. The device includes a plurality of hair styling attachments. Each of the attachments has a pair of apertures in a lower end thereof for receipt of the pair of electric prongs therein when the lower end of the attachment is coupled with the indented upper end of the housing.

1 Claim, 4 Drawing Sheets

TRAVELLING HAIR DRYING CURLING AND STYLING APPARATUS

BACKGROUND OF THE INVENTION

1. Field of the Invention

The present invention relates to a travelling hair drying, curling, and styling apparatus and more particularly pertains to allowing a user to travel with a singular apparatus for styling one's hair with a travelling hair drying, curling, and styling apparatus.

2. Description of the Prior Art

The use of electric hair curlers is known in the prior art. More specifically, electric hair curlers heretofore devised and utilized for the purpose of curling hair are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,743,735 to Abura et al. discloses an electric hair curler with detachable handle containing rechargeable batteries and charger.

U.S. Pat. No. 4,857,702 to Cafaro discloses a battery powered electrical curling iron with detachable wand and self-contained battery charger.

U.S. Pat. No. 4,516,561 to Stawski et al. discloses a portable battery powered blower apparatus for fanning charcoal or other fuel.

U.S. Pat. No. 5,117,090 to Askins discloses an electric hair curling apparatus including a removable battery pack and a fiber optic cable illumination arrangement.

U.S. Pat. No. 4,641,010 to Abura et al. discloses a battery powered electric hair curler.

U.S. Pat. No. 4,533,818 to Green discloses an electric hair curler with self-contained battery power supply.

While these devices fulfill their respective, particular objective and requirements, the aforementioned patents do not describe a travelling hair drying, curling, and styling apparatus for allowing a user to travel with a singular apparatus for styling one's hair.

In this respect, the travelling hair drying, curling, and styling apparatus according to the present invention substantially departs from the conventional concepts and designs of the prior art, and in doing so provides an apparatus primarily developed for the purpose of allowing a user to travel with a singular apparatus for styling one's hair.

Therefore, it can be appreciated that there exists a continuing need for new and improved travelling hair drying, curling, and styling apparatus which can be used for allowing a user to travel with a singular apparatus for styling one's hair. In this regard, the present invention substantially fulfills this need.

SUMMARY OF THE INVENTION

In the view of the foregoing disadvantages inherent in the known types of electric hair curlers now present in the prior art, the present invention provides an improved travelling hair drying, curling, and styling apparatus. As such, the general purpose of the present invention, which will be described subsequently in greater detail, is to provide a new and improved travelling hair drying, curling, and styling apparatus and method which has all the advantages of the prior art and none of the disadvantages To attain this, the present invention essentially comprises a hollow cylindrical housing having an indented upper end and an open lower end. The open lower end has an access panel hingedly secured thereto. The open lower end extends upwardly into a battery chamber within the housing. The battery chamber contains a pair of batteries therein. The housing has an on/off switch secured within an intermediate sidewall thereof. The on/off switch is electrically coupled with the battery chamber. The indented upper end has a pair of electric prongs extending upwardly therethrough. The electric prongs is electrically coupled with the on/off switch. The indented upper end has a pair of L-shaped recesses formed on opposing sides thereof. The device includes a curling brush iron attachment having temperature control knob thereon. The attachment has a pair of apertures in a lower end thereof for receipt of the pair of electric prongs therein when the lower end of the attachment is coupled with the indented upper end of the housing. The lower end of the attachment has a pair of flanges on opposing sides thereof adapted for coupling with the L-shaped recesses of the housing for securement of the attachment to the housing. The device includes a styling blow dryer attachment having a pair of apertures in a lower end thereof for receipt of the pair of electric prongs therein when the lower end of the dryer attachment is coupled with the indented upper end of the housing. The lower end of the dryer attachment has a pair of flanges on opposing sides thereof adapted for coupling with the L-shaped recesses of the housing for securement of the dryer attachment to the housing. The device includes a curling iron attachment having a pair of apertures in a lower end thereof for receipt of the pair of electric prongs therein when the lower end of the iron attachment is coupled with the indented upper end of the housing. The lower end of the iron attachment has a pair of flanges on opposing sides thereof adapted for coupling with the L-shaped recesses of the housing for securement of the iron attachment to the housing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved travelling hair drying, curling, and styling apparatus which has all the advantages of the prior art electric hair curlers and none of the disadvantages.

It is another object of the present invention to provide a new and improved travelling hair drying, curling, and styling apparatus which may be easily and efficiently manufactured and marketed.

It is a further object of the present invention to provide a new and improved travelling hair drying, curling, and styling apparatus which is of durable and reliable construction.

An even further object of the present invention is to provide a new and improved travelling hair drying, curling, and styling apparatus which is susceptible of a low cost of manufacture with regard to both materials and labor, and which accordingly is then susceptible of low prices of sale to the consuming public, thereby making such a travelling hair drying, curling, and styling apparatus economically available to the buying public.

Still yet another object of the present invention is to provide a new and improved travelling hair drying, curling, and styling apparatus which provides in the apparatuses and methods of the prior art some of the advantages thereof, while simultaneously overcoming some of the disadvantages normally associated therewith.

Even still another object of the present invention is to provide a new and improved travelling hair drying, curling, and styling apparatus for allowing a user to travel with a singular apparatus for styling one's hair.

Lastly, it is an object of the present invention to provide a new and improved travelling hair drying, curling, and styling apparatus comprised of a battery powered hollow cylindrical housing having an indented upper end. The indented upper end has a pair of electric prongs extending upwardly therethrough. The device includes a plurality of hair styling attachments. Each of the attachments has a pair of apertures in a lower end thereof for receipt of the pair of electric prongs therein when the lower end of the attachment is coupled with the indented upper end of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
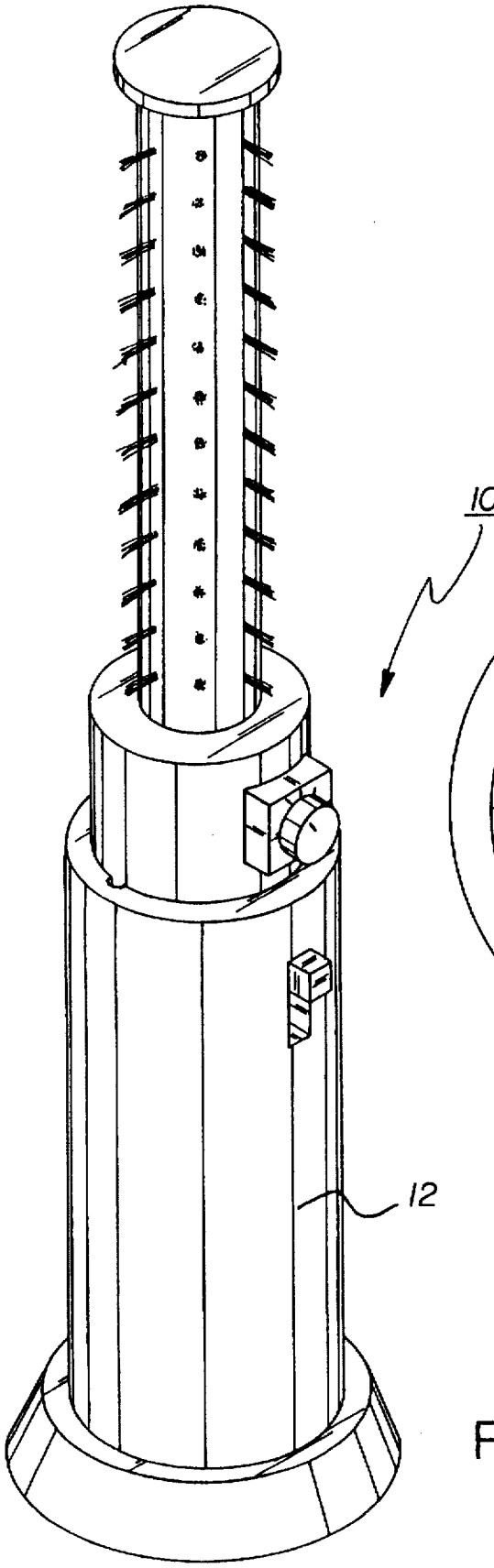
FIG. 1 is a perspective view of the preferred embodiment of the travelling hair drying, curling, and styling apparatus constructed in accordance with the principles of the present invention.
Figure 2:
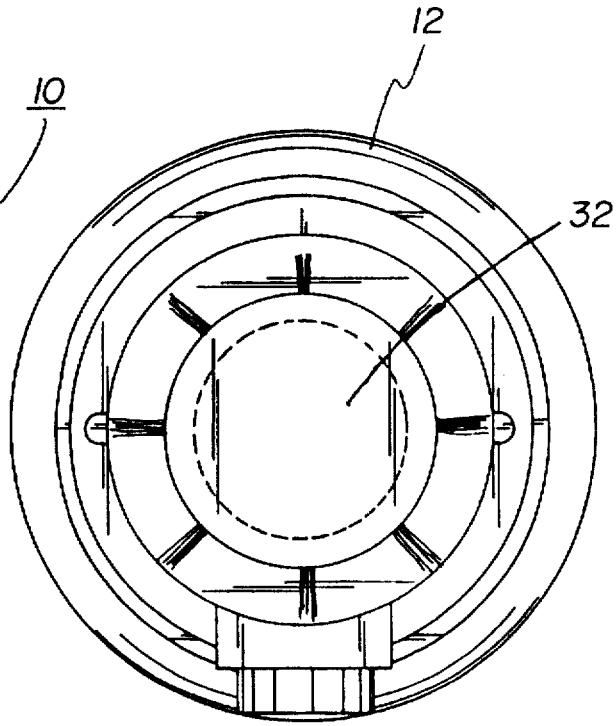
FIG. 2 is a plan view of the preferred embodiment of the present invention.
Figure 3:
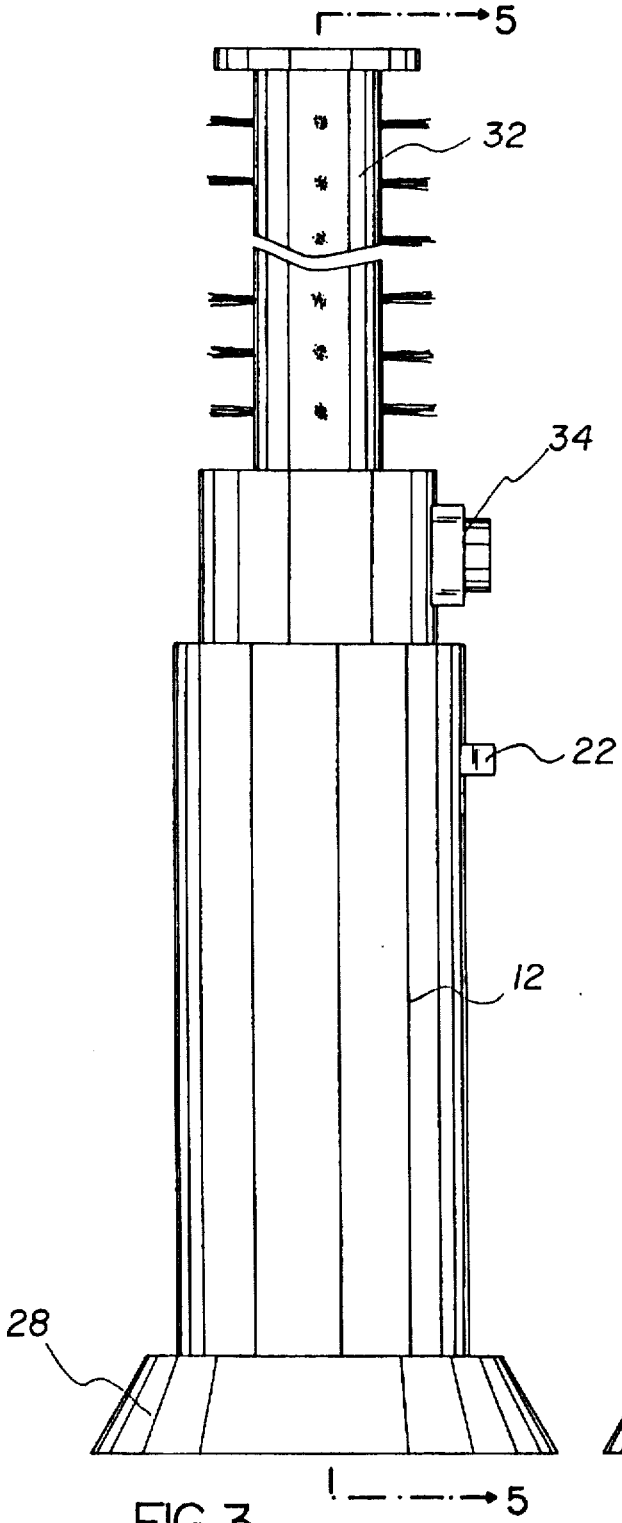
FIG. 3 is a side elevation view of the present invention.
Figure 4:
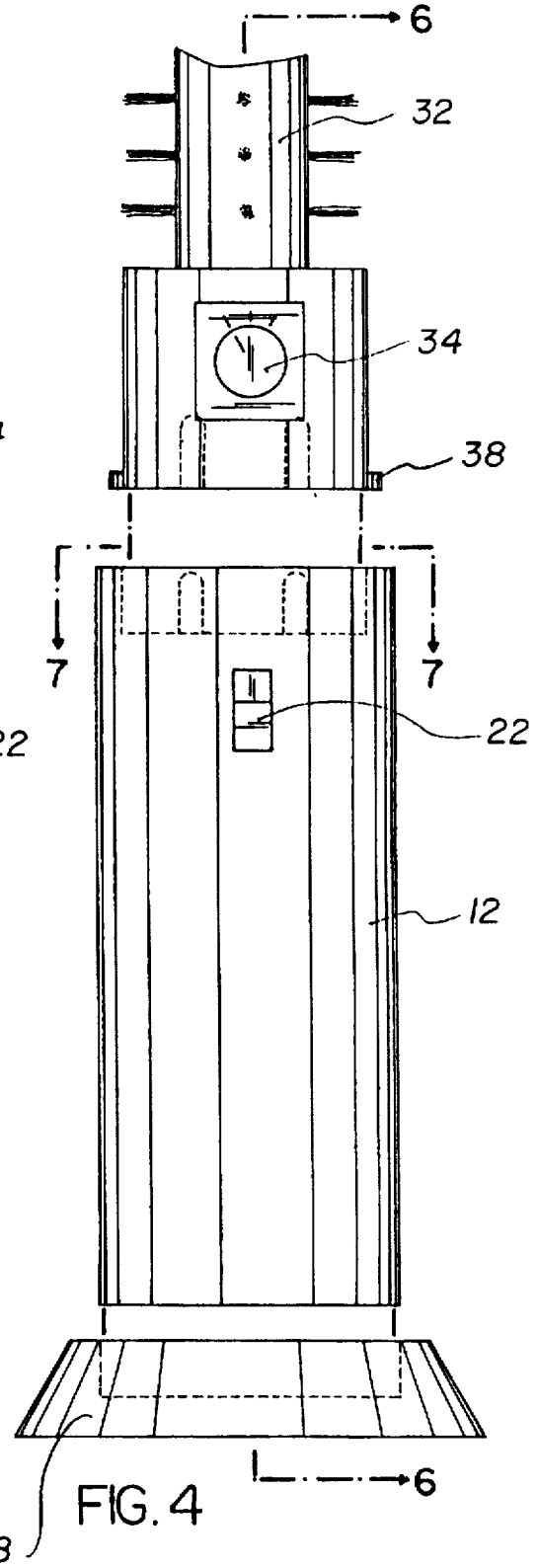
FIG. 4 is a front elevation view of the present invention.
Figure 5:
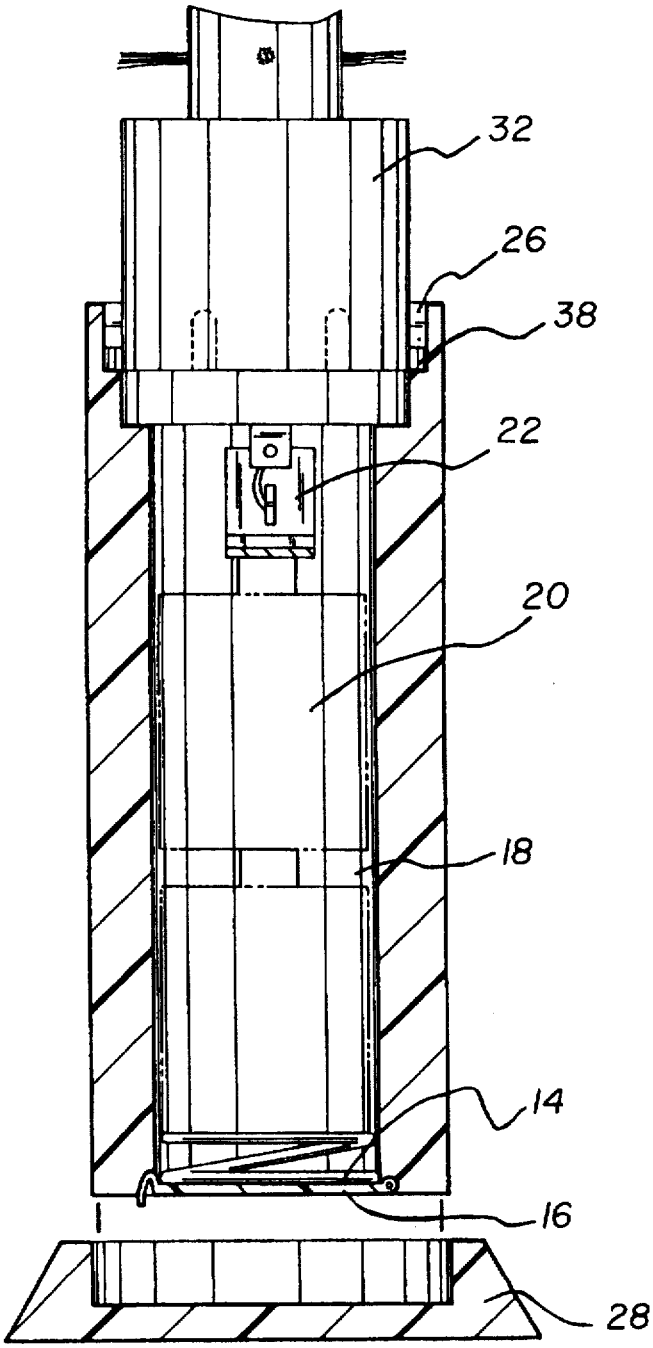
FIG. 5 is a cross-sectional view as taken along line 5—5 of FIG. 3.
Figure 6:
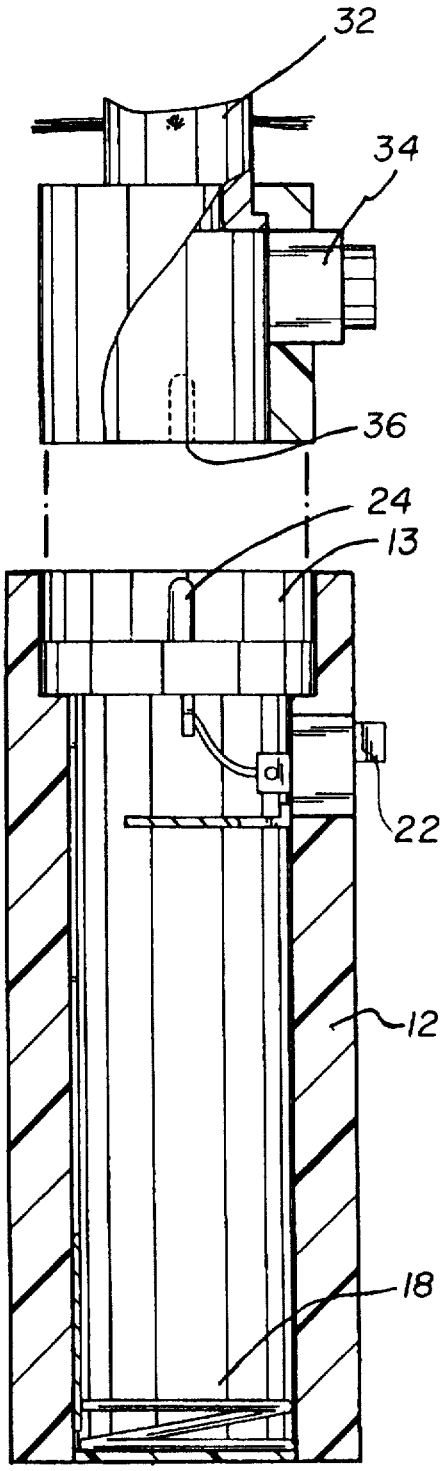
FIG. 6 is a cross-sectional view as taken along line 6—6 of FIG. 4.
Figure 7:
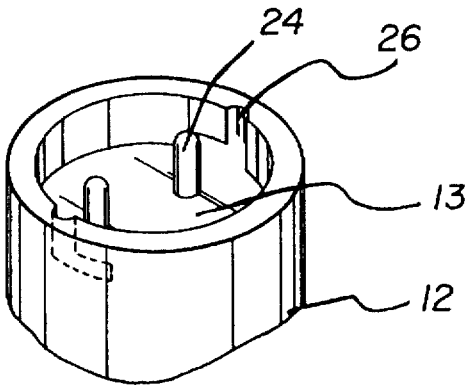
FIG. 7 is a cross-sectional view as taken along line 7—7 of FIG. 4.
Figure 8:
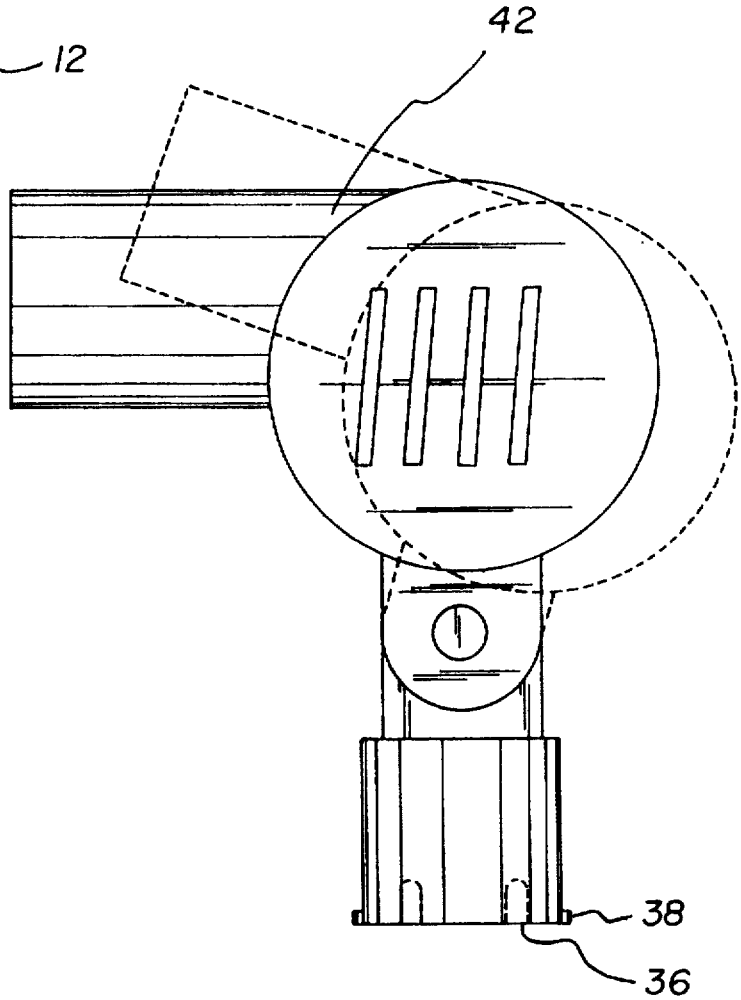
FIG. 8 is a side view of the styling blow dryer attachment of the present invention.
Figure 9:
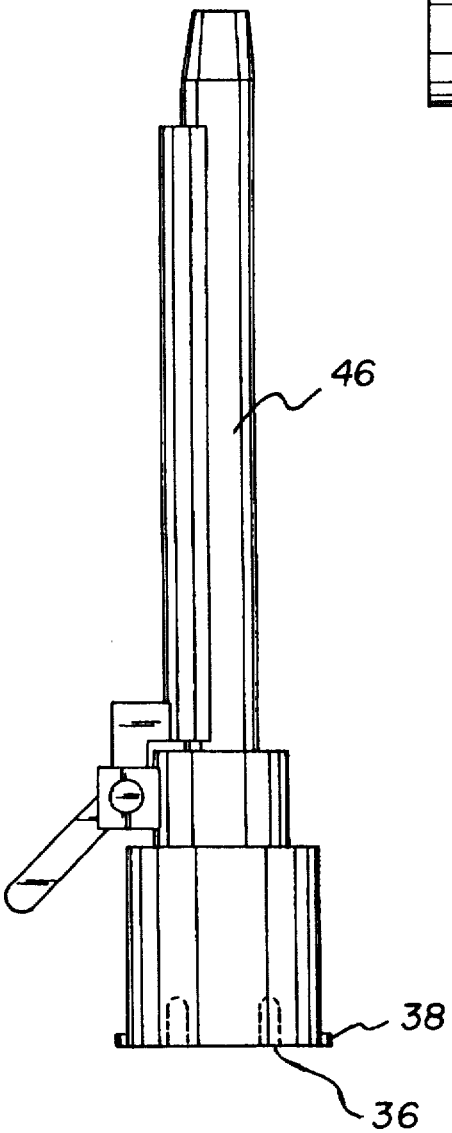
FIG. 9 is a side view of the curling rod iron attachment of the present invention.

With reference now to the drawings, and in particular, to FIG's 1–9 the re of, the preferred embodiment of the new and improved travelling hair drying, curling, and styling apparatus embodying the principles and concepts of the present invention and generally designated by the reference number 10 will be described.

Specifically, it will be noted in the various Figures that the device relates to a new and improved travelling hair drying, curling, and styling apparatus for allowing a user to travel with a singular apparatus for styling one's hair. In its broadest context, the device consists of a hollow cylindrical housing, a curling brush iron attachment, a styling blow dryer attachment, and a curling iron attachment. Such components are individually configured and correlated with respect to each other so as to attain the desired objective.

The device 10 includes a hollow cylindrical housing 12 having an indented upper end 13 and an open lower end 14. The open lower end 14 has an access panel 16 hingedly secured thereto. The open lower end 14 extends upwardly into a battery chamber 18 within the housing 12. The battery chamber 18 contains a pair of batteries 20 therein. The housing 12 has an on/off switch 22 secured within an intermediate sidewall thereof. The on/off switch 22 is electrically coupled with the battery chamber 18. The indented upper end 13 has a pair of electric prongs 24 extending upwardly therethrough. The electric prongs 24 are electrically coupled with the on/off switch 22. The indented upper end 13 has a pair of L-shaped recesses 26 formed on opposing sides thereof. The housing 12 also contains a removable stand 28 that is dimensioned to receive the lower end 14 of the housing 12 therein to support the housing 12 in an upright position.

The device 10 includes a curling brush iron attachment 32 having temperature control knob 34 thereon. The attachment 32 has a pair of apertures 36 in a lower end thereof for receipt of the pair of electric prongs 24 therein when the lower end of the attachment 32 is coupled with the indented upper end 13 of the housing 12. The lower end of the attachment 32 has a pair of flanges 38 on opposing sides thereof adapted for coupling with the L-shaped recesses 26 of the housing 12 for securement of the attachment 32 to the housing 12.

The device 10 includes a styling blow dryer attachment 42 having a pair of apertures 36 in a lower end thereof for receipt of the pair of electric prongs 24 therein when the lower end of the dryer attachment 42 is coupled with the indented upper end 13 of the housing 12. The lower end of the dryer attachment 42 has a pair of flanges 38 on opposing sides thereof adapted for coupling with the L-shape d recesses 26 of the housing 12 for securement of the dryer attachment 42 to the housing 12.

The device 10 includes a curling iron attachment 46 having a pair of apertures 36 in a lower end thereof for receipt of the pair of electric prongs 24 therein when the lower end of the iron attachment 46 is coupled with the indented upper end 13 of the housing 12. The lower end of the iron attachment 46 has a pair of flanges 38 on opposing sides thereof adapted for coupling with the L-shaped recesses 26 of the housing 12 for securement of the iron attachment 46 to the housing 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A travelling hair drying, curling, and styling apparatus for allowing a user to travel with a singular apparatus for styling one's hair comprising, in combination:

a hollow cylindrical housing having an upper end with an indentation therein and an open lower end, the open lower end having an access panel hingedly secured thereto, the open lower end extending upwardly into a battery chamber within the housing, the battery chamber containing a pair of batteries therein, the housing having an on/off switch secured within an intermediate sidewall thereof, the on/off switch being electrically coupled with the battery chamber, the indentation at the upper end having a pair of electric prongs extending upwardly therethrough, the electric prongs being electrically coupled with the on/off switch, the indentation at the upper end further having a pair of L-shaped recesses formed on opposing sides thereof, the housing further containing a removable stand dimensioned to receive the lower end of the housing therein to support the same in an upright position;

a curling brush iron attachment having temperature control knob thereon, the attachment having a pair of apertures in a lower end thereof for receipt of the pair of electric prongs therein when the lower end of the attachment is coupled with the indented upper end of the housing, the lower end of the attachment having a pair of flanges on opposing sides thereof adapted for coupling with the L-shaped recesses of the housing for securement of the attachment to the housing;

a styling blow dryer attachment having a pair of apertures in a lower end thereof for receipt of the pair of electric prongs therein when the lower end of the dryer attachment is coupled with the indented upper end of the housing, the lower end of the dryer attachment having a pair of flanges on opposing sides thereof adapted for coupling with the L-shaped recesses of the housing for securement of the dryer attachment to the housing; and a curling iron attachment having a pair of apertures in a lower end thereof for receipt of the pair of electric prongs therein when the lower end of the iron attachment is coupled with the indented upper end of the housing, the lower end of the iron attachment having a pair of flanges on opposing sides thereof adapted for coupling with the L-shaped recesses of the housing for securement of the iron attachment to the housing.

* * * * *